United States Patent [19]

Jacobson

[11] Patent Number: 4,908,945

[45] Date of Patent: Mar. 20, 1990

[54] DISPOSABLE COMBINATION RAZOR AND SHAVING CREAM DISPENSER

[76] Inventor: Jeffrey A. Jacobson, 409 Emerald Bay, Laguna Beach, Calif. 92651

[21] Appl. No.: 287,382

[22] Filed: Dec. 19, 1988

Related U.S. Application Data

[63] Continuation-in-part of Ser. No. 22,665, Mar. 6, 1987, Pat. No. 4,791,223, which is a continuation-in-part of Ser. No. 819,696, Jan. 17, 1986, abandoned.

[51] Int. Cl.[4] ..... B26B 19/44

[52] U.S. Cl. ..... 30/41; 30/86

[58] Field of Search ..... 30/41, 86, 90; 222/131, 222/192, 402.13

[56] References Cited

U.S. PATENT DOCUMENTS

| | | | |
|---|---|---|---|
| 3,417,468 | 12/1968 | Miyauchi | 30/41 |
| 3,726,009 | 4/1973 | Hackmyer | 30/41 |
| 4,077,119 | 3/1978 | Sellera | 30/41 |
| 4,433,483 | 2/1984 | Lazarus | 30/41 |

FOREIGN PATENT DOCUMENTS

| | | | |
|---|---|---|---|
| 2583672 | 12/1986 | France | 30/41 |
| 653595 | 1/1986 | Switzerland | 30/41 |

*Primary Examiner*—Douglas D. Watts

*Attorney, Agent, or Firm*—Poms, Smith, Lande & Rose

[57] ABSTRACT

A disposable combination razor and shaving cream dispenser having an aerosol actuated push button shaving cream dispenser and a non-removable cap having a razor blade at the upper end and a pushbutton adapted to engage the push button of the dispenser. In this manner, the dispenser body may be used as a handle when shaving and the cream may be dispensed without removing the cap from the dispenser as needed to be applied by the hand into which the cream is dispensed.

21 Claims, 3 Drawing Sheets

Fig. 2.
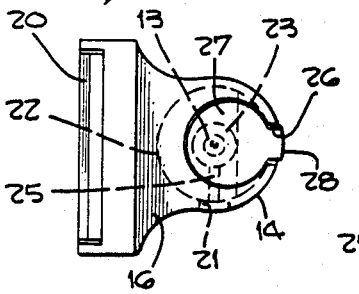
Fig. 4.
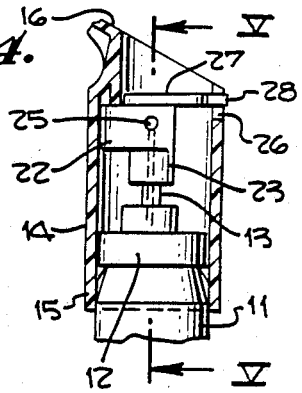
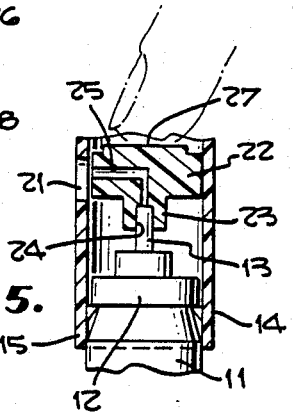
Fig. 5.
Fig. 1.
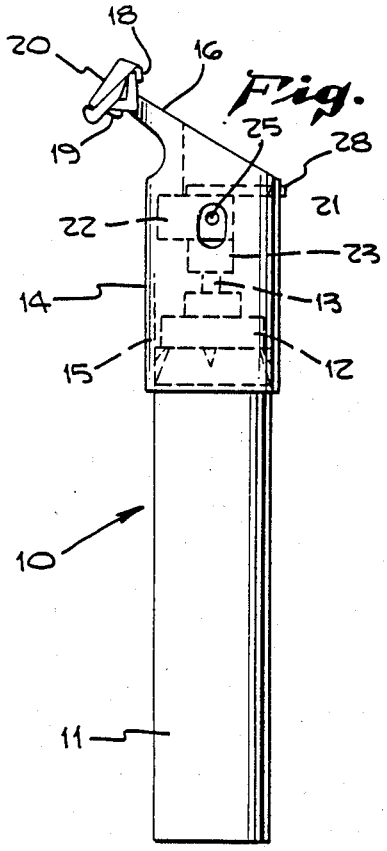
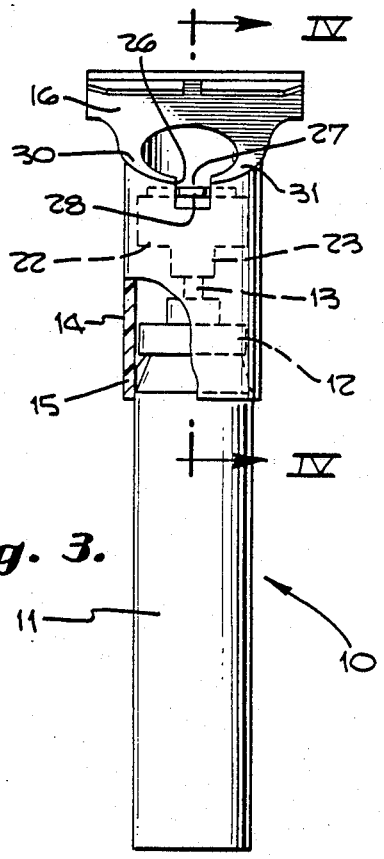
Fig. 3.

DISPOSABLE COMBINATION RAZOR AND SHAVING CREAM DISPENSER

RELATION TO OTHER CASES

This application is a continuation-in-part of Application Ser. No. 07/022,665, filed Mar. 6, 1987 now U.S. Pat. No. 4,791,223, which in turn is a continuation-in-part of Application Ser. No. 06/819,696, filed Jan. 17, 1986, now abandoned.

BACKGROUND OF THE INVENTION

1. Field of the Invention

The invention relates to razor assemblies; and, more particularly, to a disposable combination razor and shaving cream dispenser.

2. Description of the Prior Art

Although electric razors have become popular in recent years, many people still prefer to shave manually. This, of course, requires shaving cream and a razor. When travelling, space is often a problem and one who desires to shave with a razor blade must carry a bulky aerosol actuated shaving cream dispenser can in addition to a razor.

In U.S. Pat. No. 4,433,483 to Lazarus, there is described a disposable razor assembly wherein an elongated cylindrical aerosol-operated shaving cream dispenser, of a diameter substantially less than that of a conventional can of shaving cream, is provided. The dispenser body has a cup closing off the top with a razor blade carried by the cap. The cap must be removed from the dispenser body to actuate the push button of the dispenser to dispense the shaving cream.

Thus, the interior of the cap must be kept to close tolerances to provide a tight fit to the top of the dispenser body but allow easy removal. In addition, it is dangerous for the user to have to remove the cap while shaving since the blade is exposed and since it is part of the cap, it must be gripped in that area to remove the cap. For example, men may merely lather their face once while shaving but women may lather their legs or the like many times while shaving in locations, such as a shower, where their hands are wet and soapy. There is thus a strong chance for cutting since the blade is part of the cap. Because the cap must be placed on and taken off each time the device is used, the fit becomes less firm and the cap works itself loose and moves back and forth when shaving therefore changing the angle of the cutting edges on your face resulting in uneven shaving. Obviously, the cap must be loose enough to be removed but firm enough to shave.

In U.S. Pat. No. 3,726,009 to Hackmyer, a self-lathering shaver is disclosed having an aerosol can where shaving cream is dispensed out of a razor blade attached to the can. This is quite messy and applies shaving cream to the blade dispensing the same while shaving. This is certainly not as effective as applying cream to one's hand where it can be properly rubbed into the face and whiskers of the user to moisturize the same. Thus, there is a substantial amount of waste in the shaver of Hackmyer. The cream comes out of the blades and, thus, one must have such cream coming out constantly to provide sufficient cream for shaving. This uses up a substantial amount of cream quickly and makes it dangerous to shave when the skin is not properly moisturized. Also, since such a device uses a substantial amount of cream, the teachings of Hackmyer could not be adapted to a disposable shaver which must utilize as little cream as possible in each application.

In some such devices, one's finger is right under the blade when the cream is dispensed. There is a need for such a dispenser where the operator's finger is remote from the blade and the cream is directly dispensed into the palm of one's hand.

There is thus a need for a disposable combination razor and shaving cream dispenser which is convenient, practical, safe, cab be operated with a single hand and whereby it is not necessary to remove the cap to dispense the shaving cream therefrom and the cap thus need not be manufactured to close tolerances, can have a permanent-type fit, whereas prior art devices must be so manufactured to provide for frequent removal and resealing.

SUMMARY OF THE INVENTION

It is an object of this invention to provide a disposable combination razor and shaving cream dispenser.

It is a further object of this invention to provide such a razor combination wherein the cap or top need not be internally machined to provide for closure of the top of the dispenser portion as in the prior art devices.

It is still further an object of this invention to provide such a razor combination where shaving cream can be dispensed without removal of the cap or top.

These and other objects of the invention are preferably accomplished by providing a disposable combination razor and shaving cream dispenser having an aerosol actuated push button shaving cream dispenser sealed at the top, having a razor blade at the upper end thereof and a push-button adapted to engage with the actuating valve of the dispenser. In this manner, the dispenser body may be used as a handle when shaving and the cream may be dispensed directly from the dispenser into one's hand for application to one's body at a point remote from the blade.

BRIEF DESCRIPTION OF THE DRAWING

FIG. 1 is a vertical side view of a combination razor and shaving cream dispenser in accordance with the invention;

FIG. 2 is a top plan view of the combination of FIG. 1;

FIG. 3 is a vertical front view, partly in section, of the combination of FIGS. 1 and 2;

FIG. 4 is a view, partly in section, taken along lines IV—IV of FIG. 3;

FIG. 5 is a view, partly in section, taken along lines V—V of FIG. 4 illustrating the operation of the combination of FIGS. 1-5;

DESCRIPTION OF THE PREFERRED EMBODIMENT

Figure 6:
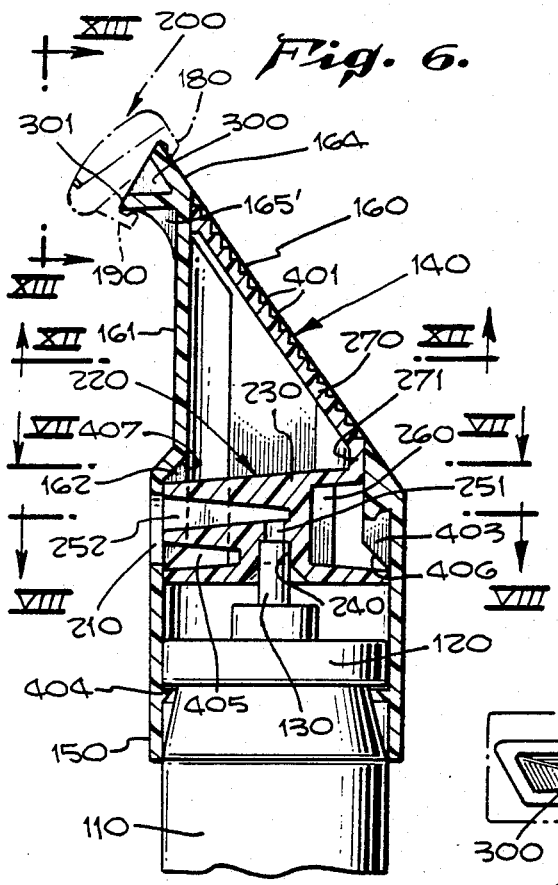
FIG. 6 is a vertical side view, partly in section, of another embodiment of a combination razor and shaving cream dispenser in accordance with the invention.

Referring now to FIG. 1 of the drawing, a device 10 is shown of a combined razor and shaving cream dispenser. Device 10 comprises a shaving cream dispenser having a body 11 closd off at the top by a sealing cap 12 with a valve stem 13 extending through the cap 12 down into the interior of body 11 and in fluid communication with the contents thereof. It is to be understood that the contents of body 11 are under pressure and are dispensed out of valve stem 13 on downward pressure of stem 13. Dispenser body 11, cap 12 and stem 13 comprise a conventional aerosol can, as is well known in the art, and contains shaving cream under pressure therein. Body 11 has a relatively small diameter compared to conventional shaving cream dispensers and is elongated as shown to provide a handle when the device 10 is used as a razor.

Body 11 is closed off at the top by a top 14. Top or cap 14 is hollow on the interior (see particularly FIGS. 3–5) having a lower thin walled cylindrical portion 15 and an upper flanged portion 16 flaring outwardly away from cap portion 15. Cap 14 and cap 12 provide sealing means for device 10.

Flanged portion 16 terminates in an L-shaped flange 17 adapted to be received between upper and lower elongated lips 18, 19, respectively, provided on the rear mounting surface of a conventional single edge safety razor blade 20. Thus, blade 20 can be easily and quickly removed from flange 17 and discarded and replaced, as desired.

Cap 14 may be permanently and non-removably secured to dispenser body 11, if desired. Cap 14 has an opening 21 (FIGS. 1 and 5), which may be elongated, communicating with the interior of cap 14. A one-piece valve 22 (see particularly FIG. 5) is disposed interiorly of cap 14 having a main body portion of a diameter slightly less than the inner diameter of cap portion 15 so that the cylindrical inner wall of portion 15 acts as a guide for valve 22 as it reciprocates up and down within cap portion 15. Thus, valve 22 includes a boss 23 having an opening 24 (FIG. 5) receiving therein in close fitting relationship the upper end of valve stem 13. An L-shaped fluid passageway 25 is provided in valve 22. Passageway 25 communicates with both the interior of valve stem 13 and the exterior of valve 22 (see FIG. 4). As seen in FIG. 5, passageway 25 opens into the area encompassed by the opening 21 in cap 14.

As seen in FIG. 4, the flange portion 16 is undercut at 26 on the side thereof opposite blade 20. Valve 22 includes a push button portion 27 at the top thereof within undercut section 26 resiliently and pivotally connected to the wall of cap portion 15 as a resilient hinge 28 (FIG. 4). It can be appreciated that access to push button 27 is provided on the exterior of device 10 without removal of cap 14. Pushing button portion 27 (FIG. 5) pushes valve 22 downwardly actuating valve stem 13 to dispense the contents (shaving cream) of body 11 under pressure out of passageway 25 through opening 21. Resilient hinge 28 is such that, upon release of button 27 portion, the valve 22 returns to its original inoperative position as is well known in the aerosol can art.

Referring now to FIGS. 6 to 11 of the drawing, another embodiment 100 is shown of a combined razor and shaving cream dispenser. Device 100 (FIG. 6) comprises a shaving cream dispenser having a body 110 closed off at the top by a sealing cap 120 with a valve stem 130 extending through the cap 120 down into the interior of body 110 and in fluid communication with the contents thereof. It is to be understood that the contents of body 110 are under pressure as discussed hereinabove with respect to FIGS. 1 to 5 and dispenser body 110, cap 120 and stem 130 comprise a conventional aerosol can, as is well known in the art, and the can contains shaving cream under pressure therein. Body 110 has a relatively small diameter compared to conventional shaving cream dispensers and is elongated as shown to provide a handle when the device 100 is used as a razor.

Figure 7:
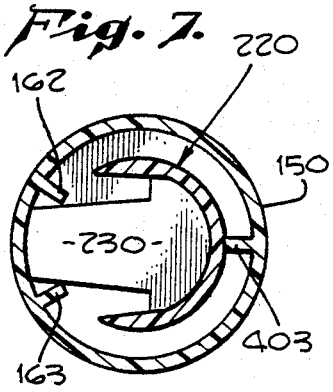
FIG. 7 is a view taken along lines VII—VII of the combination of FIG. 6.
Figure 13:
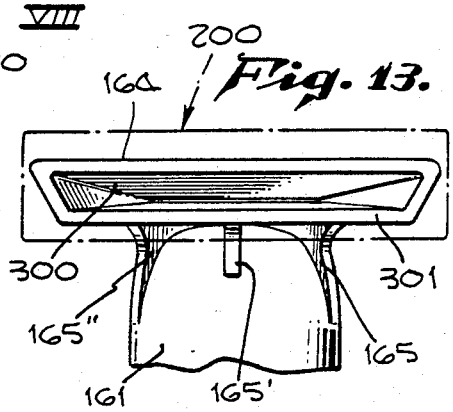
FIG. 13 is a view taken along lines XIII—XIII of FIG. 6.
Figure 12:
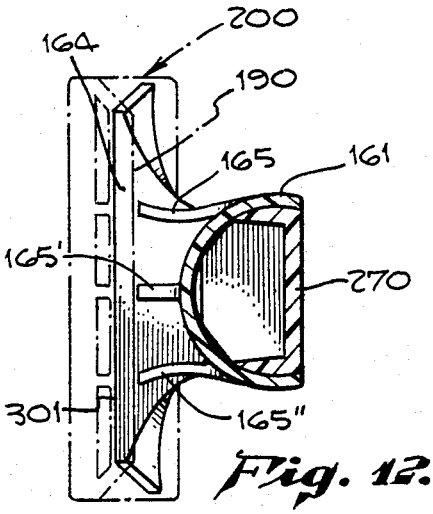
FIG. 12 is a view taken along lines XII—XII of FIG. 6.

Body 110 is closed off at the top by a cap or top 140. Top or cap 140 is hollow on the interior having a lower thin walled cylindrical portion 150 and an upper flanged portion 160 flaring outwardly away from cap portion 150. Cap 140 and cap 120 provide sealing means for device 100. Cap 140 has a semi-cylindrical upper wall portion 161 (see FIG. 7) having inwardly extending spaced flanges, 162, 163 (FIG. 7). Wall portion 161 (FIG. 6) terminates at its upper end in an outwardly flared trapezoidally-shaped member 164 (FIG. 13). A plurality of spaced flanges, such as flanges 165, 165′ and 165″ (see also FIG. 12) are provided on the underside of wall portion 161 interconnecting the same to member 164. The interior 300 of member 164 is hollowed out to provide a thin walled outer peripheral edge 301. A pair of upper and lower elongated lips 180, 190, respectively, are provided on the rear mounting surface of a conventional safety razor blade 200. Thus, blade 200 can be easily and quickly slid onto the peripheral lip 301 of member 164 (see FIG. 6) and easily removed and is discarded and replaced, as desired.

Cap 140 may be permanently and non-removably secured to dispenser body 110, if desired. Cap 140 has an opening 210 (see also FIG. 9), which may be elongated, communicating with the interior of cap 140. A one-piece button 220 (FIGS. 6, 7, 8 and 10) is disposed interiorly of cap 140 having a main body portion of a diameter slightly less than the inner diameter of cap portion 150 so that the cylindrical inner wall of portion 150 acts as a guide for button 220 as it reciprocates up and down within cap portion 150. Thus, button 220 includes a boss 230 at the lower end thereof having an opening 240 receiving therein in close fitting relationship the upper end of valve stem 130. A fluid passageway is provided in button 220 comprised of a vertical passageway 251 communicating with a flared rectangularly shaped generally horizontal passageway 252 (see also FIG. 9) with opening 210. The outer diameter of stem 130 is greater than the diameter of passageway 251 so as not to seal off flow of cream therethrough. Passageway 252 communicates with both the interior of valve stem 130 via passageway 251 and the exterior of button 220 and opening 210. As seen in FIG. 6, passageway 252 opens into the area encompassed by the opening 210 in cap 140.

Figure 8:
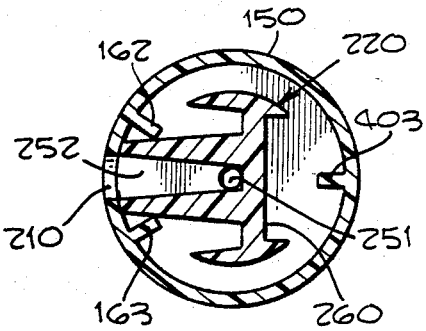
FIG. 8 is a view taken along lines VIII—VIII of FIG. 6.
Figure 11:
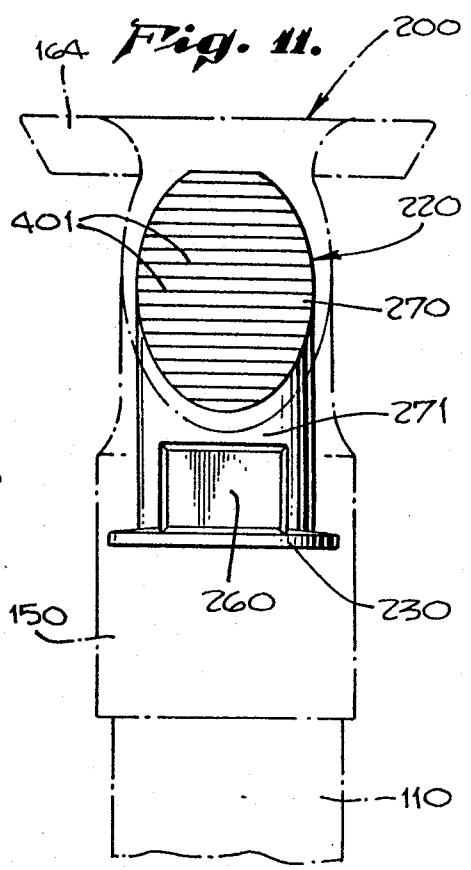
FIG. 11 is a vertical rear view, partly in phantom, of the combination of FIG. 1.
Figure 10:
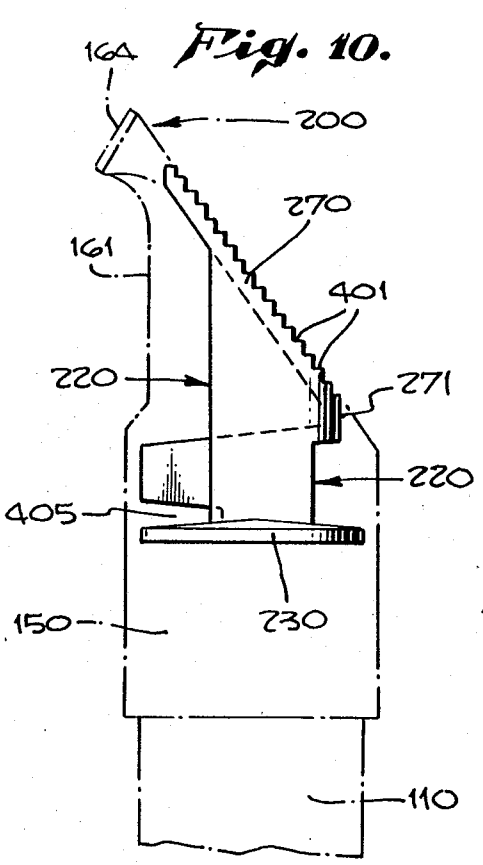
FIG. 10 is a vertical side view, partly in phantom, of the top portion of the combination of FIG. 6.
Figure 9:
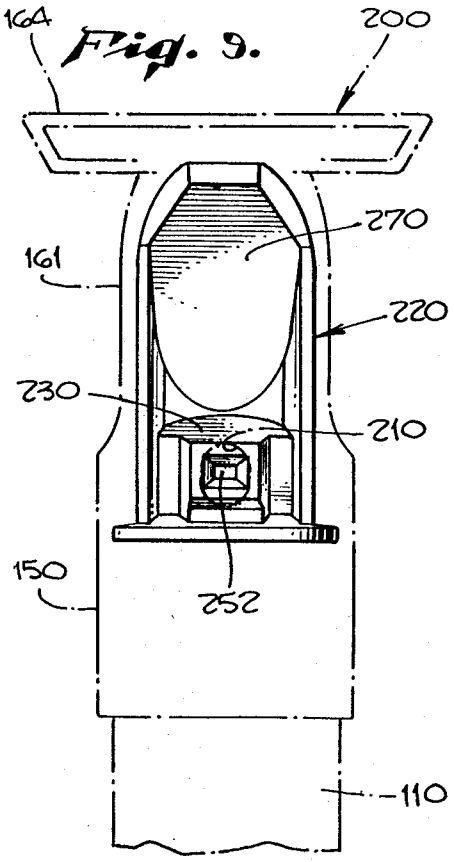
FIG. 9 is a vertical front view, partly in phantom, of the top portion of the combination of FIG. 6.

As seen in FIG. 6, a cavity 260 is provided on the boss 230 of cap 140 at the rear thereof (see also FIG. 8). Button 220 includes a push button portion 270 at the top thereof, which may be roughened or ribbed, as ribs 401 (see also FIGS. 10 and 11). It can be appreciated that access to push button portion 270 is provided on the exterior of device 100 without removal of cap 140. Pushing button portion 270 (FIG. 6), downwardly which is coupled to boss 230 via integral flange 271, pushes button 220 downwardly actuating valve stem 130 to dispense the contents (shaving cream) of body 110 under pressure out of passageways 251, 252 through opening 210 as discussed hereinabove with respect to the embodiment of FIGS. 1 to 5.

As seen in FIGS. 6 and 7, vertical rib 403 extends downwardly at the top of cap portion 150 at the rear thereof. An annular rib 404 extends about the open bottom of cap portion 150 on the inner wall thereof, tapered on the bottom. Boss 230 may be cut away at area 405 forming a lower generally flexible portion. In assembling button 220 inside of cap 140, the button 220 is inserted through the open portion 150 upwardly within cap 140 over flange 404 and between flanges 162, 163. The tapered surface 407 of wall 161 and the tapered surface 406 of rib 403 acts as a stop for button 220. Body 110 is now inserted into cap 140 with cap 120 moving past and over flange 404 with valve 130 entering passageway 240 on a friction-fit arrangement. The friction fit between opening 240 in boss 230 and valve stem 130 is such that, when the button portion 270 is pushed downwardly, foam is ejected through opening 210 under blade 200 and preferably on the same side thereof, then valve stem 130 returns to its initial inoperative position upon release of push button portion 270.

Obviously, where practical, devices 10 and 100 may be made of suitable plastics and molded in one piece. For example, the caps 14 and 140 may be molded in one piece. Although a simple connection for the razor blade is provided, obviously any well-known connecting means for a blade may be used.

Any suitable dimensions may be used except that it is contemplated that the dispenser body be of a size to use the same comfortably as a handle when shaving. The entire device may be sold at a price making it attractive to purchasers. Since the cap of my invention need not be selectively removed and replaced, it need not be manufactured to those tolerances necessary to accomplish the same. Also, since the actuating button portion is recessed within the undercut section of the flanged portion of the cap, the side walls (see walls 30, 31 in FIG. 3 and 165, 403 and surrounding areas in FIG. 6) provide a guard so that the recessed button portion cannot be pressed accidentally and a traveler can transport the device safely and comfortably without concern for accidental discharge of the shaving cream. Finally, since the cap or top need not be removed to dispense shaving cream, it is quite safe and can be used in the shower or the like without danger of cutting. In the FIG. 6 embodiment, the entire valve is a single one-piece device enabling the combination to be quickly and easily and inexpensively manufactured.

The member 164 is formed in a manner saving on plastics. If it were solid, it would be prohibitively expensive. The peripheral lip 300 and hollowed out member 164 provides maximum stability and eliminates blade vibration. This prevents the blade from moving back and forth and gives a smooth steady shave.

Of course, in both embodiments of the invention, the caps 14 and 140 may be made removable so as to attach another can thereto. Blades 20 and 200 may be slid off and another inserted therein. As discussed, it is not necessary to remove caps 14 and 140 to dispense the cream so the device herein is safer than those prior art devices where the cap removal is needed, by gripping the neck area, to dispense cream; this may result in one cutting one's hands since such hands may be wet and may slip to the blade area. Both hands must be used to dispense foam in these prior art devices or the device must be supported against something to actuate the release means for the foam. Cream is only effective when dispensed to one's hands, then rubbed into the skin in even layers as opposed to constant emission upon actuation as in the prior art devices. Thus, the device herein is more economical than those prior art devices that dispense cream out of the shaving head where it is easily pushed away and may result in the users cutting their skin in areas not covered by cream. Since such a device as disclosed herein is desirably of a size to be disposable, it can only carry a limited supply of cream. Prior art devices that cannot be used to dispense cream into one's hand wastes cream and cannot be made readily disposable after a preselected number of uses. Since the cream does not exit from the blade, which has been proven to be ineffective, and does not rely on up and down movement of the shaving head, which gives a wobbly manner which may change the angle of the blade to one's face and where the blade is mounted, cream can be dispensed into the palm of one's hand in a firm steady manner for subsequent application to one's body. In both embodiments of the invention, the cream is emitted safely away from the blade since only a single button is depressed rather than an entire head providing an easy emission of cream and a resulting steady shave since the blade is mounted on a stationary and tight fitting shaving head. In the FIG. 6 embodiment, the cream is preferably emitted under the blade and remote therefrom. The device is convenient, economical, and the shaving head provides for a steady and close shave and takes up relatively small space in one's shaving kit or the like. Such a device is quite convenient for travelers and military personnel. In addition to the above, it is useful and economical enough to be used regularly on a daily basis even when not travelling or the like.

I claim:

1. A disposable razor and shaving cream dispenser combination including a shaving cream dispenser body closed off by first sealing means at the top sealing the contents therein under pressure with a valve stem extending through the sealing means in fluid communication with the contents normally sealing off said contents until depressed, a button mounted on said valve stem having a fluid passageway communicating at one end with the interior of said valve stem and the other end with the exterior of said button, second sealing means closing off said valve stem on top of said body having a lower main body portion and a flanged portion flaring away from said main body portion having a razor blade holder thereon adapted to receive a safety razor blade therein, the improvement which comprises:

said fluid passageway being remote from said razor blade holder having passage means for discharging cream in a direction away from said body and remote from said blade and blade holder so that cream does not touch said blade and blade holder; and push button means secured to the top of said button accessible from the exterior of said second sealing means for pushing on said button to actuate said valve stem without removal of said second sealing means from said dispenser body to dispense cream out of said body through said passageway at a point remote from and below said blade and said blade holder and in a direction away from said blade and blade holder.

2. In the combination of claim 1 wherein said push button means includes a push button portion resiliently hinged to said button.

3. In the combination of claim 1 wherein said push button means is freely movable within said second sealing means.

4. In the combination of claim 1 wherein said flanged portion includes an undercut section on the side thereof opposite said blade holder, said undercut section having an upstanding wall therearound with said push button being disposed within said upstanding wall, said upstanding wall extending above said push button and protecting said push button from inadvertent pushing thereof.

5. In the combination of claim 1 wherein an opening is provided in said second sealing means communicating with the passageway through said button.

6. In the combination of claim 5 wherein said push button means has a cavity on the rear thereof, said interior wall of said second sealing means having a rib on the inner rear wall thereof, said rib acting as a stop for said push button means.

7. In the combination of claim 5 wherein second sealing means communicates with the passageway through said button, said opening in said second sealing means being elongated.

8. In the combination of claim 1 wherein said dispenser body is cylindrical and elongated.

9. In the combination of claim 1 wherein the razor blade is removably mounted in said holder.

10. In the combination of claim 1 wherein said fluid passageway opens at a point directly below the razor blade holder so as to emit cream in a direction parallel to the sharp edge of a blade received in said holder.

11. In the combination of claim 1 wherein said fluid passageway includes a first generally vertical portion and a second outwardly flared generally horizontal portion.

12. In the combination of claim 1 wherein said razor blade holder comprises an outwardly flared portion having a thin peripheral edge, and a safety razor blade having upper and lower flanges, said peripheral edge being receivable between said upper and lower flanges thereby removably securing said blade to said flared portion.

13. In the combination of claim 12 wherein said flared portion is generally trapezoidally-shaped.

14. In the combination of claim 12 wherein the interior of said flared portion is hollowed out on the side opening away from said dispenser body.

15. In the combination of claim 12 wherein a plurality of spaced flanges are provided interconnecting said flared portion to a semi-cylindrical portion integral with said main body portion.

16. A self contained disposable razor and shaving cream dispenser combination including a shaving cream dispenser body closed off by first sealing means at the top sealing the contents therein under pressure with a valve stem extending through said first sealing means in fluid communication with the contents within said body normally sealing off said contents until depressed, a button mounted on said valve stem having a fluid passageway communicating at one end with the interior of said valve stem and the other end with the exterior of said button, second sealing means closing off said valve stem on the top of said body including a lower main body portion and a flanged portion flaring away from said main body portion having a razor blade holder thereon receiving therein a safety razor blade, the improvement which comprises:

said fluid passageway being remote from said razor blade holder having passage means for discharging cream in a direction away from said body and remote from said blade and blade holder so that cream does not touch said blade and blade holder; and push button means associated with said top recessed with respect to the outer planar surface of said top for actuating said valve stem without removal of the top of said second sealing means from said dispenser body to dispense cream out of said body remote from said blade and through an opening in said second sealing means remaining stationary when said valve stem is actuated to dispense cream out of said opening.

17. In the combination of claim 16 wherein said push button means includes a push button portion resiliently hinged to said button.

18. In the combination of claim 16 wherein said flanged portion includes an undercut section on the side thereon opposite said blade holder, said undercut section having an upstanding wall therearound with said push button being disposed within said upstanding wall, said upstanding wall extending above said push button and protecting said push button from inadvertent pushing thereof.

19. In the combination of claim 16 wherein said opening in said second sealing means is elongated.

20. In the combination of claim 16 wherein said dispenser body is cylindrical and elongated.

21. In the combination of claim 16 wherein the razor blade is removably mounted in said holder.

* * * * *